US006082014A

United States Patent [19]

Beyers

[11] Patent Number: 6,082,014

[45] Date of Patent: Jul. 4, 2000

[54] CHALK LINE END

[75] Inventor: Greg L. Beyers, Bloomington, Ind.

[73] Assignee: GLB Tool, LLC, Bloomington, Ind.

[21] Appl. No.: 09/137,388

[22] Filed: Aug. 20, 1998

Related U.S. Application Data

[60] Provisional application No. 60/056,503, Aug. 20, 1997.

[51] Int. Cl.[7] ..... B44D 3/38

[52] U.S. Cl. ..... 33/414; 33/413; 33/758; 33/756

[58] Field of Search ..... 33/414, 413, 758, 33/756, 755

[56] References Cited

U.S. PATENT DOCUMENTS

| | | | |
|---|---|---|---|
| 1,303,756 | 5/1919 | Ballou | 33/758 |
| 1,798,476 | 3/1931 | Langsner | 33/758 |
| 4,143,462 | 3/1979 | Gertz | 33/414 |

FOREIGN PATENT DOCUMENTS

| | | | |
|---|---|---|---|
| 2233097 | 1/1997 | United Kingdom | 33/755 |

*Primary Examiner*—Christopher W. Fulton
*Attorney, Agent, or Firm*—Woodard, Emhardt, Naugton Moriarty & McNett Patent and Trademark Attorneys

[57] ABSTRACT

A chalk line end is disclosed which includes a substantially flat base member having first and second tabs depending therefrom in order to form a substantially 90 degree angle to the base member. First and second points extend from the respective first and second tabs and are sized and shaped so as to press into the side surface of a board when the chalk line end is positioned over the board edge. This arrangement facilitates maintaining the position of the chalk line end as the chalk line is drawn off at an angle to the board edge. As an optional feature, a chalk line mount may be coupled to the base member by means of a swiveling connector, such as a rivet. This swiveling connection facilitates drawing the chalk line off at an angle from the board edge.

21 Claims, 5 Drawing Sheets

CHALK LINE END

CROSS REFERENCE TO RELEASED APPLICATION

This application claims the benefit of U.S. Provisional Application Ser. No. 60/056,503, filed Aug. 20, 1997.

TECHNICAL FIELD OF THE INVENTION

The present invention generally relates to hand tools and, more particularly, to a chalk line end.

BACKGROUND OF THE INVENTION

As is known in the art, a chalk line end is attached to the end of a chalk line in order to securely hold that end of the chalk line while the chalk line is stretched into place in preparation for snapping a line on an adjacent surface.

A prior art chalk line 10 is illustrated in FIG. 1. A chalk line 12 is tied to the chalk line end 10, and the chalk line end 10 is hooked over the edge of a board 14 in order to provide an anchor point for marking chalk lines upon the board 14. The prior art chalk line end 10 is effective only for marking chalk lines which are formed substantially at a 90 degree angle from the edge of the board 14 (known as "cross-chalking"). Any attempt to mark a chalk line at an angle from the edge of the board 14 results in the chalk line end 10 being pulled off of the edge of the board 14.

In order to form chalk marks at angles to the edge of the board 14 with the prior art chalk line end 10, it is necessary to drive a nail into the board 14 near the edge of the board and then hook the chalk line end 10 around the nail. Alternatively, a saw may be used to cut a notch into the end of the board 14 into which the chalk line 12 may be inserted in order to hold the chalk line 12 while a chalk mark is formed at an angle. A third alternative is to have a helper hold the end 10 of the chalk line 12 while the line 12 is pulled off at an angle, therefore requiring two people to perform this operation. Such extra manipulations are very time consuming and detract from the usefulness of the prior art chalk line end 10.

There is therefore a need for a chalk line end which will allow a single operator to conveniently mark chalk lines from the edge of a board at any angle as easily as marking a chalk line 90 degrees from the edge of the board. The present invention is directed toward meeting this need.

SUMMARY OF THE INVENTION

A chalk line end is disclosed which includes a substantially flat base member having first and second tabs depending therefrom in order to form a substantially 90 degree angle to the base member. First and second points extend from the respective first and second tabs and are sized and shaped so as to press into the side surface of a board when the chalk line end is positioned over the board edge. This arrangement facilitates maintaining the position of the chalk line end as the chalk line is drawn off at an angle to the board edge. As an optional feature, a chalk line mount may be coupled to the base member by means of a swiveling connector, such as a rivet. This swiveling connection facilitates drawing the chalk line off at an angle from the board edge.

In one form of the invention, a chalk line end is disclosed, comprising: a base member; a first tab coupled to the base member and formed at a substantially 90 degree angle to the base member; a second tab coupled to the base member and formed at a substantially 90 degree angle to the base member, the second tab being spaced from the first tab; a first point coupled to the first tab and formed at a substantially 90 degree angle to the first tab; a second point coupled to the second tab and formed at a substantially 90 degree angle to the second tab; and a chalk line mount pivotally coupled to the base member.

In another form of the invention, a chalk line end is disclosed, comprising: a base member; a first tab coupled to the base member and formed at a substantially 90 degree angle to the base member; a second tab coupled to the base member and formed at a substantially 90 degree angle to the base member, the second tab being spaced from the first tab; a first point coupled to the first tab and formed at a substantially 90 degree angle to the first tab; a second point coupled to the second tab and formed at a substantially 90 degree angle to the second tab; and a first hole formed through the base member, wherein a chalk line may be tied through the hole.

In another form of the invention, a chalk line end is disclosed, comprising: a base member; at least one tab coupled to the base member and formed at a substantially 90 degree angle to the base member; and a chalk line mount pivotally coupled to the base member.

DETAILED DESCRIPTION OF THE PREFERRED EMBODIMENTS

Figure 1:
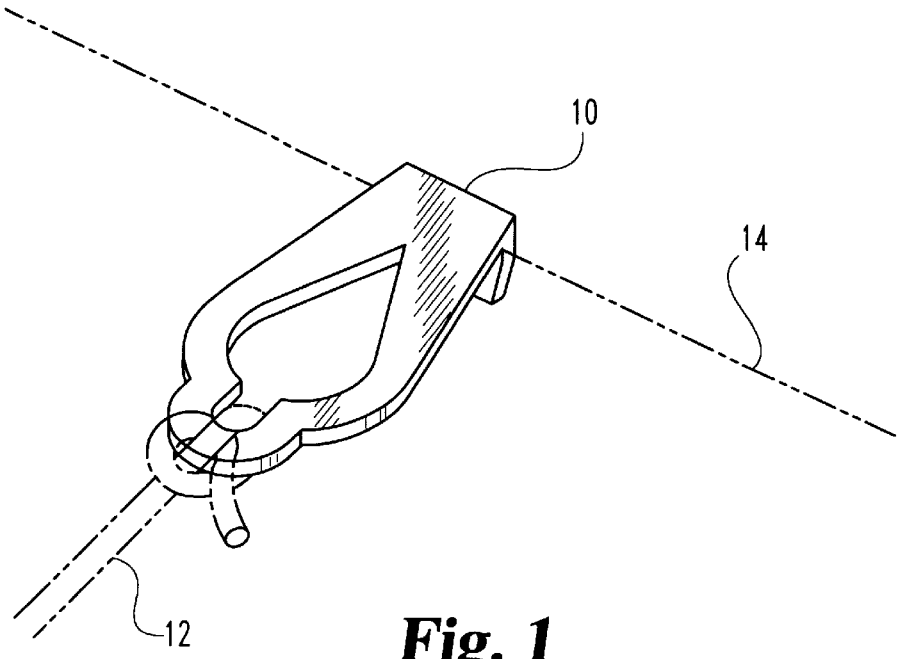
Fig. 1 (PRIOR ART)
FIG. 1 is a perspective view of a prior art chalk line end.
Figure 2:
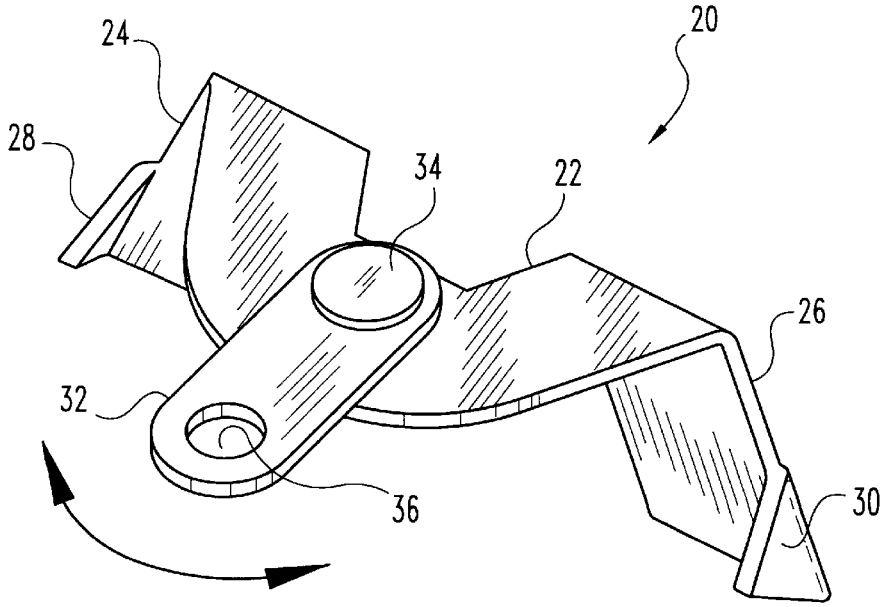
FIG. 2 is a perspective view of a preferred embodiment chalk line end of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A preferred embodiment chalk line end of the present invention is illustrated in FIGS. 2–10 and indicated generally at 20. The chalk line end 20 includes a substantially flat base member 22, first and second tabs 24 and 26 formed substantially at a 90 degree angle to the base member 22, a first point 28 formed at substantially a 90 degree angle to the first tab 24, and a second point 30 formed at substantially a 90 degree angle to the second tab 26, as shown.

The chalk line end 20 further includes a chalk line mount 32 coupled to the base member 22 by means of a rivet 34 or the like. The coupling between the chalk line mount 32 and the base member 22 is loose, such that the chalk line mount 32 is free to swivel about the rivet 34. A hole 36 is formed into the chalk line mount 32 in order to facilitate tying the chalk line thereto.

Figure 9:
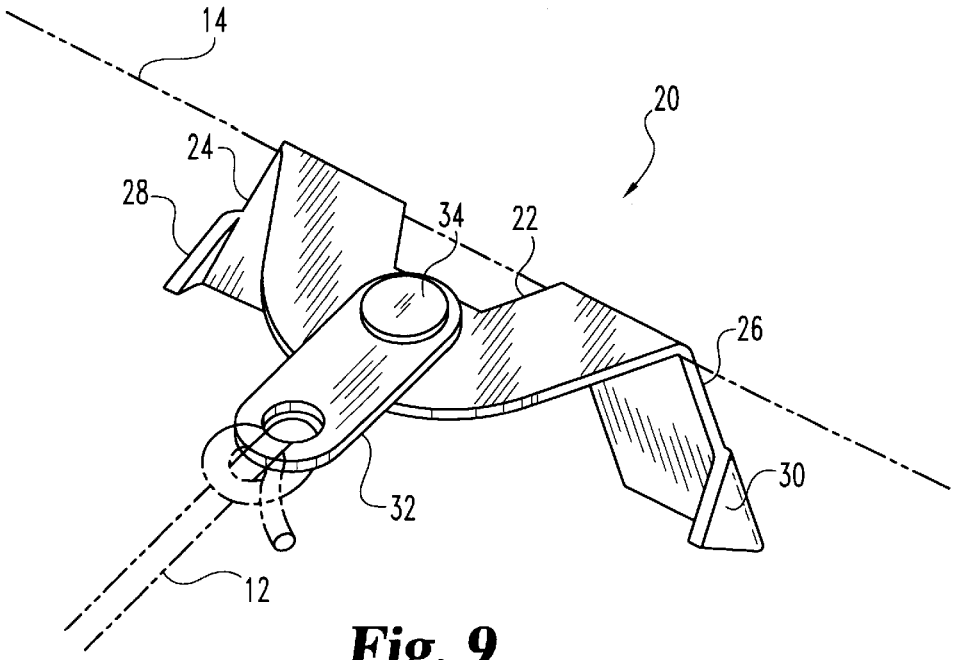
FIG. 9 is a perspective view of the preferred embodiment of the present invention mounted to the edge of a board.

As illustrated in FIG. 9, the chalk line end 20 may be mounted to the straight edge of a board by placing the tabs 24 and 26 upon the side edge of the board 14 and pressing the points 28 and 30 into the surface of the side of the board 14. Once thus mounted, the chalk line mount 32 may be swiveled to any angle with respect to the edge of the board 14 in order to create a mark with the chalk line. Because the points 28 and 30 are embedded into the side surface of the board 14, pulling the chalk line at an angle to the chalk line end 20 will not cause the chalk line end 20 to become disengaged from the side of the board 14.

Figure 3:
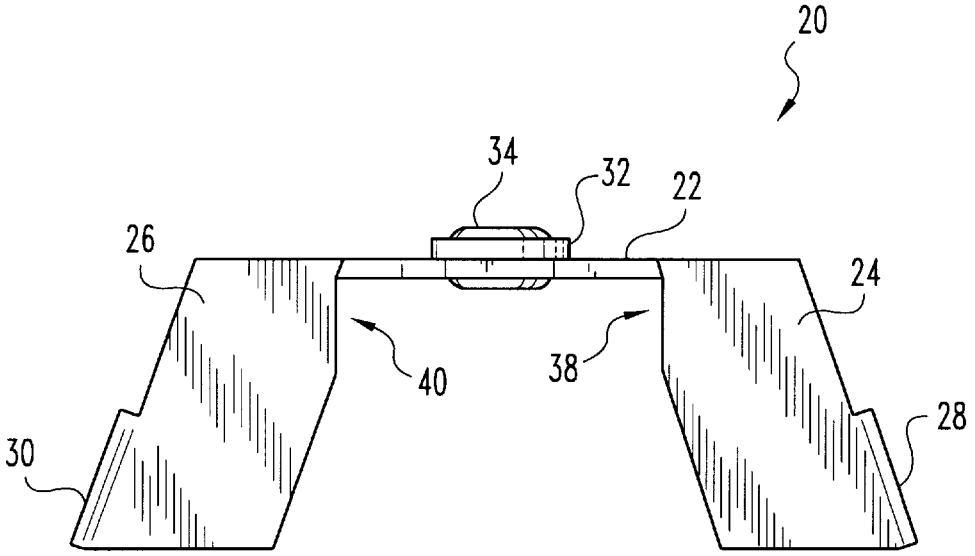
FIG. 3 is a front elevational view of the preferred embodiment of the present invention.
Figure 4:
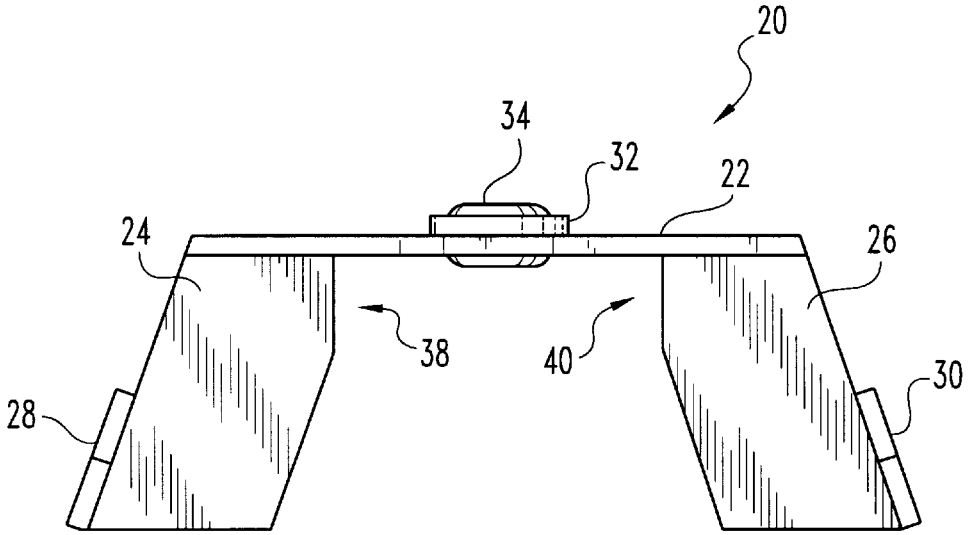
FIG. 4 is a rear elevational view of the preferred embodiment of the present invention.
Figure 5:
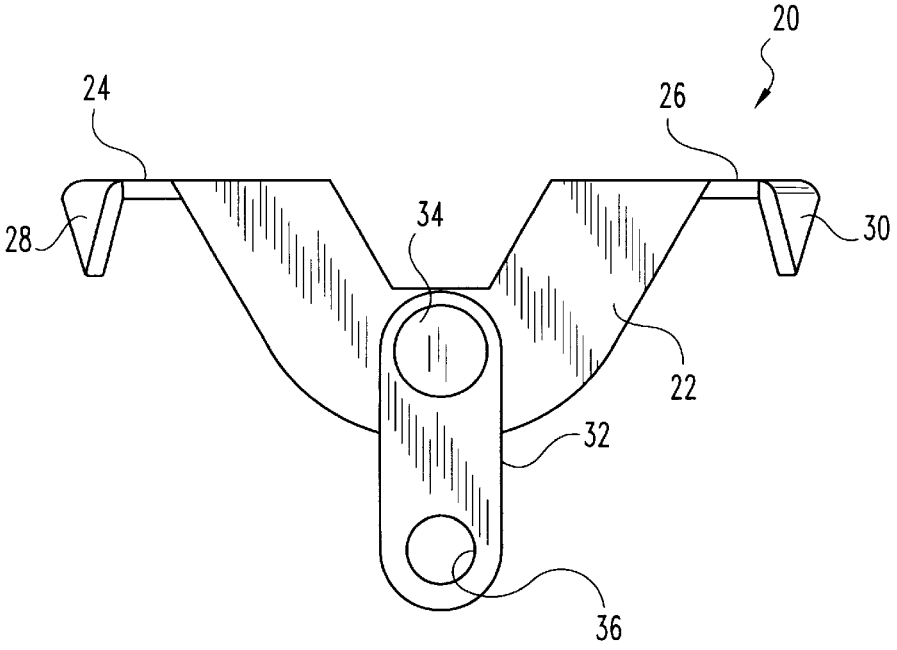
FIG. 5 is a top plan view of the preferred embodiment of the present invention.
Figure 6:
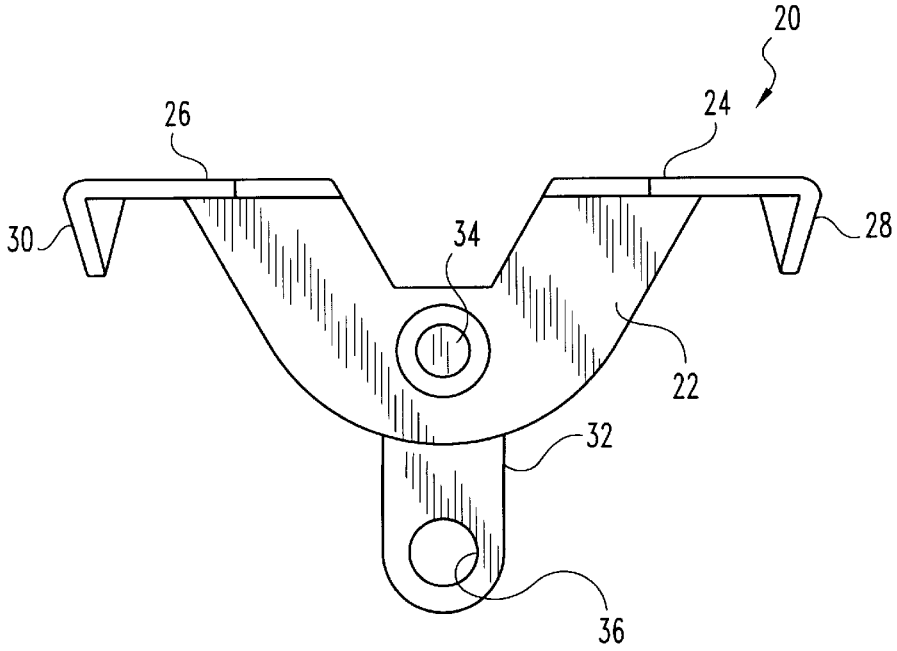
FIG. 6 is a bottom plan view of the preferred embodiment of the present invention.
Figure 7:
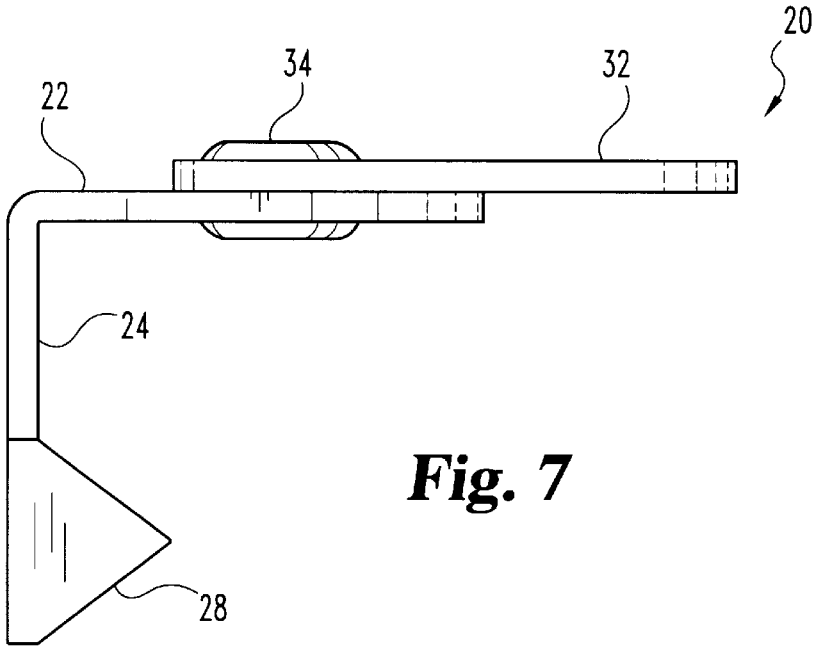
FIG. 7 is a left side elevational view of the preferred embodiment of the present invention.
Figure 8:
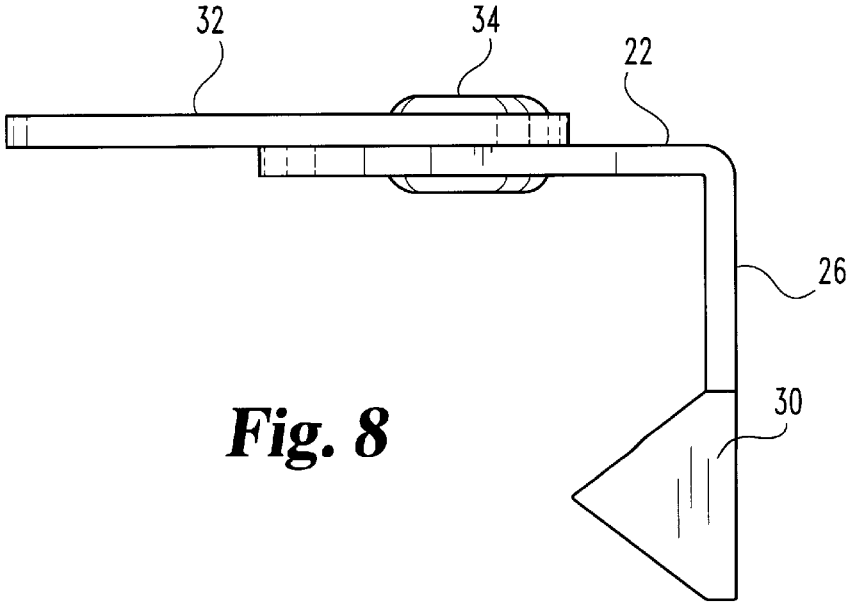
FIG. 8 is a right side elevational view of the preferred embodiment of the present invention.
Figure 10:
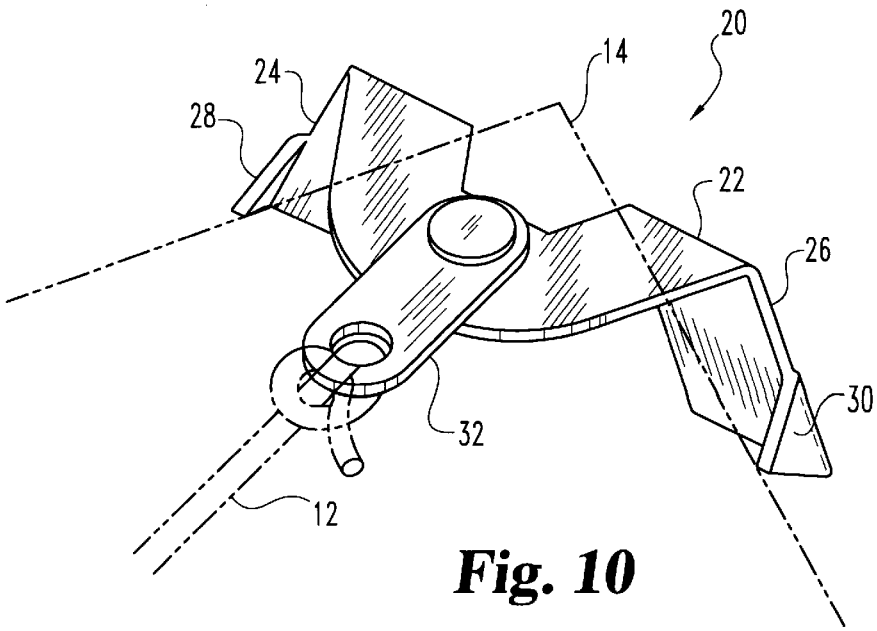
FIG. 10 is a perspective view of the preferred embodiment of the present invention mounted to the corner of a board.

As most clearly seen in FIGS. 3 and 4, the chalk line end 20 further preferably includes a first notch 38 formed into the first tab 24 and a second notch 40 formed into the second tab 26. The notches 38 and 40 allow the chalk line end 20 to be secured to the corner of a board, as illustrated in FIG. 10. The notches 38 and 40 engage the sides of the board 14 on either side of the corner, and the points 28 and 30 engage the side surfaces of the board 14. Thus mounted, the chalk line end 20 of the present invention allows a chalk mark to be made at any angle from the corner of the board 14.

In a first alternative embodiment of the present invention, the chalk line end 20 illustrated in FIGS. 2–10 may be modified in order to place the rivet 34 (or other pivot point) as close as possible to the plane of the tabs 24 and 26. This will, in turn, place the pivot point as close as possible to the edge of the board (which engages the tabs 24 and 26). Placement of the pivot point as close as possible to the board edge simplifies the process of marking the chalk line at accurate angles from a specific point on the edge of the board, because the rivet 34 may simply be placed at this point. With the preferred embodiment design described hereinabove, a slight adjustment must be made in the positioning of the chalk line end 20 from such a point due to the fact that the pivot point (such as the rivet 34) is located at a fixed distance from the edge of the board. As will be appreciated with reference to the above description, the cut-out portion of the base member 22 will need to be filled in the first alternative embodiment in order to provide an attachment point for the rivet 34 which is closer to the edge of the board.

In a second alternative embodiment, the chalk line end may be formed as described hereinabove with respect to the preferred embodiment or the first alternative embodiment, with the exception that the chalk line mount 32 and rivet 34 are omitted and the chalk line 12 is simply tied through the hole in the base member 22 which accepts the rivet 34. In this second alternative embodiment of the present invention, smoothness in moving the chalk line 12 to various angles is diminished, however, the parts count and assembly cost of the chalk line end is significantly reduced.

The chalk line end of the present invention, in any of its alternative embodiments, is preferably formed from steel, however any material strong enough to hold the desired shape and to be pressed into the wood to be marked may be used. Additionally, the swivel mount attachment is described herein as the rivet 34, however those having ordinary skill in the art will recognize that any means for attaching the chalk line mount 32 to the base member 22 such that these two members may be made to change their angular orientation with respect to one another is comprehended by the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A chalk line end, comprising:

a base member;

a first tab coupled to the base member and formed at a substantially 90 degree angle to the base member;

a second tab coupled to the base member and formed at a substantially 90 degree angle to the base member, the second tab being spaced from the first tab;

a first point coupled to the first tab and formed at a substantially 90 degree angle to the first tab;

a second point coupled to the second tab and formed at a substantially 90 degree angle to the second tab; and a chalk line mount pivotally coupled to the base member.

2. The chalk line end of claim 1, wherein the base member, the first and second tabs, the first and second points, and the chalk line mount are all formed from steel.

3. The chalk line end of claim 1, wherein the base member is substantially U-shaped.

4. The chalk line end of claim 1, wherein the first and second points are substantially triangular.

5. The chalk line end of claim 1, further comprising:

a rivet pivotally coupling the chalk line mount to the base member.

6. The chalk line end of claim 5, wherein the chalk line mount comprises:

an elongated member having a first end and a second end;

a first hole formed through the elongated member at the first end, wherein a chalk line may be tied through the first hole; and a second hole formed through the elongated member at the second end, wherein the rivet extends through the second hole.

7. The chalk line end of claim 1, further comprising:

a first notch formed into the first tab; and a second notch formed into the second tab;

wherein the first and second notches allow the chalk line end to be mounted over a corner of a board.

8. A chalk line end, comprising:

a base member;

a first tab coupled to the base member and formed at a substantially 90 angle to the base member;

a second tab coupled to the base member and formed at a substantially 90 angle to the base member, the second tab being spaced from the first tab;

a first point coupled to the first tab and formed at a substantially 90 degree angle to the first tab;

a second point coupled to the second tab and formed at a substantially 90 degree angle to the second tab;

a first notch formed into the first tab;

a second notch formed into the second tab;

a first hole formed through the base member, wherein a chalk line may be tied through the hole and wherein the first and second notches allow the chalk line end to be mounted over a corner of a board such that the base member lies in contact with a surface of the board;

a chalk line mount; and a rivet pivotally coupling the chalk line mount to the first hole.

9. The chalk line of claim 8, wherein the base member, the first and second tabs, the first and second points, and the chalk line mount are all formed from steel.

10. The chalk line end of claim 8, wherein the base member is substantially U-shaped.

11. The chalk line end of claim 8, wherein the first and second points are substantially triangular.

12. The chalk line end of claim 8, wherein the chalk line mount comprises:

an elongated member having a first end and a second end;

a first hole formed through the elongated member at the first end, wherein a chalk line may be tied through the first hole;

a second hole formed through the elongated member at the first end, wherein a chalk line may be tied through the second hole; and a third hole formed through the elongated member at the second end, wherein the rivet extends through the third hole and the fourth hole.

13. A chalk line end, comprising:

a base member;

at least one tab coupled to the base member and formed at a substantially 90 degree angle to the base member; and a chalk line mount pivotally coupled to the base member.

14. The chalk line end of claim 13, wherein said at least one tab comprises:

a first tab coupled to the base member and formed at a substantially 90 degree angle to the base member;

a second tab coupled to the base member and formed at a substantially 90 degree angle to the base member, the second tab being spaced from the first tab.

15. The chalk line end of claim 14, further comprising:

a first point coupled to the first tab and formed at a substantially 90 degree angle to the first tab;

a second point coupled to the second tab and formed at a substantially 90 degree angle to the second tab; and a chalk line mount pivotally coupled to the base member.

16. The chalk line end of claim 15, wherein the base member, the first and second tabs, the first and second points, and the chalk line mount are all formed from steel.

17. The chalk line end of claim 15, wherein the first and second points are substantially triangular.

18. The chalk line end of claim 14, further comprising:

a first notch formed into the first tab; and a second notch formed into the second tab;

wherein the first and second notches allow the chalk line end to be mounted over a corner of a board.

19. The chalk line end of claim 13, wherein the base member is substantially U-shaped.

20. The chalk line end of claim 13, further comprising:

a rivet pivotally coupling the chalk line mount to the base member.

21. The chalk line end of claim 20, wherein the chalk line mount comprises:

an elongated member having a first end and a second end, a first hole formed through the elongated member at the first end, wherein a chalk line may be tied through the first hole; and a second hole formed through the elongated member at the second end, wherein the rivet extends through the second hole.

* * * * *

UNITED STATES PATENT AND TRADEMARK OFFICE

CERTIFICATE OF CORRECTION

PATENT NO. : 6,082,014
DATED : July 4, 2000
INVENTOR(S) : Gregory L. Beyers

It is certified that error appears in the above-identified patent and that said Letters Patent is hereby corrected as shown below:

Title page,
Item [56] please add the following patents:

| | | | |
|---|---|---|---|
| -- 4,561,189 | 12/31/1985 | Hirneise | 33/408 |
| 4,731,933 | 03/22/1988 | Cope | 33/414 |
| 4,819,337 | 04/11/1989 | Noye | 33/414 |
| 4,932,135 | 05/12/1990 | Wobser, II | 33/408 |
| 4,995,152 | 02/26/1991 | Steckler | 24/129 |
| 5,212,875 | 05/25/1993 | Corso | 33/414 |
| 5,444,919 | 08/29/1995 | Alves | 33/414 |
| 5,465,494 | 11/14/1995 | Johnston | 33/414 |
| 5,509,616 | 04/23/1996 | Millen, Jr. et al. | 242/381.5 |
| 5,588,610 | 12/31/1996 | McGee | 242/379 -- |

Item [56] please change "1/1997" to -- 1/1991 --.
Under "*Attorney, Agent or Firm*", please change "Naugton" to -- Naughton --.

Signed and Sealed this

Twenty-eighth Day of May, 2002

*Attest:*

*Attesting Officer*

JAMES E. ROGAN
*Director of the United States Patent and Trademark Office*